United States Patent [19]

Kappos

[11] 4,225,059

[45] Sep. 30, 1980

[54] PORTABLE BEVERAGE COOLER AND DISPENSER

[76] Inventor: Christopher Kappos, Cambridge, Iowa 50046

[21] Appl. No.: 969,540

[22] Filed: Dec. 14, 1978

[51] Int. Cl.[3] ..... B67D 5/62

[52] U.S. Cl. ..... 222/146 C; 222/608

[58] Field of Search ..... 222/146 C, 608, 626; 62/449

[56] References Cited

U.S. PATENT DOCUMENTS

| | | | |
|---|---|---|---|
| 683,662 | 10/1901 | Rankin . | |
| 969,540 | 7/1885 | Hoffman . | |
| 1,772,111 | 8/1930 | Rice | 222/146 C X |
| 1,923,363 | 8/1933 | Fredrickson et al. | 222/145 C X |
| 1,979,549 | 11/1934 | Huckel . | |
| 3,232,489 | 2/1966 | Buffington | 222/146 C X |
| 3,263,865 | 8/1966 | Kachnik | 222/608 X |

*Primary Examiner*—Stanley H. Tollberg
*Attorney, Agent, or Firm*—Morton S. Adler

[57] ABSTRACT

An insulated ice cooled container is mounted on a wheeled road traveling trailer equipped with tongue, hitch and traveling lights and attachable to a towing motor vehicle. The container is designed to hold a plurality of receptacles for beverages such as beer kegs and the like to be transported to a point of use for on-site dispensing. Dispensing hoses for the contents of the receptacles are trained through ice in an ice chamber and connect to valved spigots mounted on and exteriorly of the container. The trailer carries apparatus for pressurizing the contents of the receptacles and includes a jack leg for maintaining a level position of the container when detached from the towing vehicle. Separate latchable doors are provided for the ice chamber and the carrying area for the receptacles.

3 Claims, 5 Drawing Figures

28
10
24
26
44
44
56
20
46
16
38
58
48
42
18
34
12
36
60
22
60

10
44
28
30
26
30
34
14
32
38
40
42
56
40
58
40
62
60
60

44
78
84
68
72
68
84
82
64
64
82

32
44
44
28
30
14
26
38
70
68
68
20
68
40
68
10
84
68
16
42
66
50
82
66
78
76
82
22
40
84
80
74
64
64
72
40
34
18
60
54
56
60
52
62
58

60
44
44
46
12
26
50
16
64
42
66
78
20
38
76
64
72
74
54
58
56
64
62
64
10
18
40
34
60
70
14

PORTABLE BEVERAGE COOLER AND DISPENSER

BACKGROUND OF THE INVENTION

This invention relates to a road travelling trailer mounted refrigerated container adapted to transport receptacles of liquid refreshments to be dispensed at a point of use directly from the container through facilities provided thereon.

Various forms and types of portable refreshment wagons have previously been designed for use within limited areas such as by street vendors and in public areas such as railway stations, sporting and entertainment areas and the like as exemplified in U.S. Pat. Nos. 321,970, 683,662, 1,772,111 and 1,979,549 and one of the important objects of the present invention is to provide a trailer mounted refrigerated container for liquid refreshments adapted to be towed by a motor vehicle to any selected site.

Another object of this invention is to provide a container of the above class which includes means for dispensing the transported beverages directly from the container at its selected destination.

A further object herein is to provide a trailer mounted container as characterized having a capacity for travelling speeds over short or long distances and on roadways comparable to that of the towing motor vehicle.

The foregoing objects and such further objects as may appear herein, or be hereinafter pointed out, together with the advantages of this invention will be more fully discussed and developed in the more detailed description of the accompanying drawings.

DESCRIPTION OF THE PREFERRED EMBODIMENTS

Figure 1:
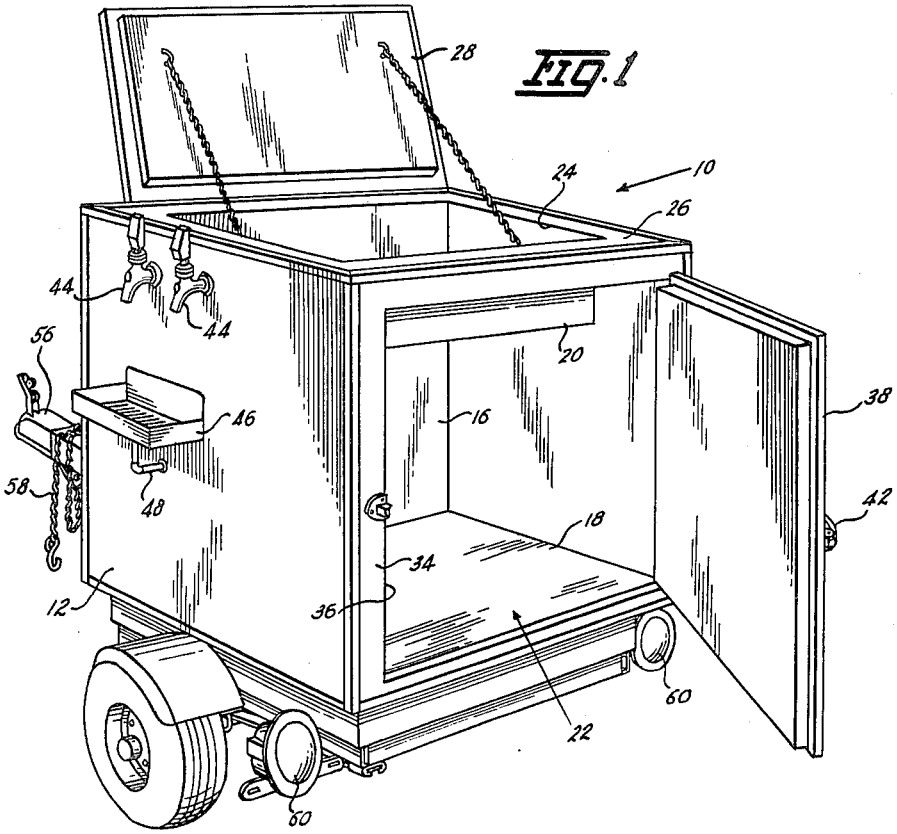
FIG. 1 is a perspective rear view of this invention showing the respective doors to the ice chamber and the beverage receptacle compartment in open position.
Figure 2:
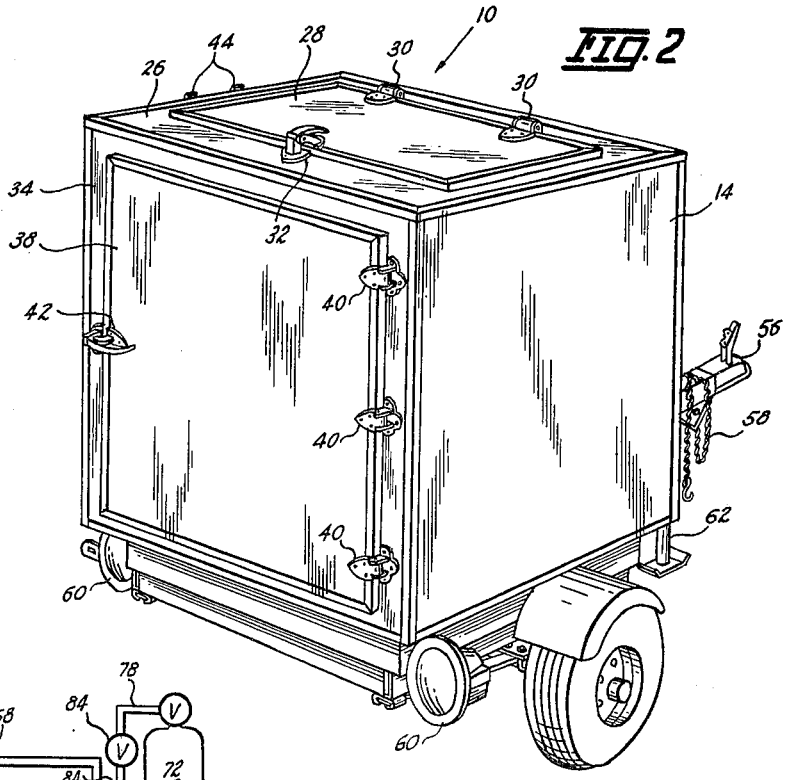
FIG. 2 is also a perspective rear view thereof showing the doors in closed position.
Figure 5:
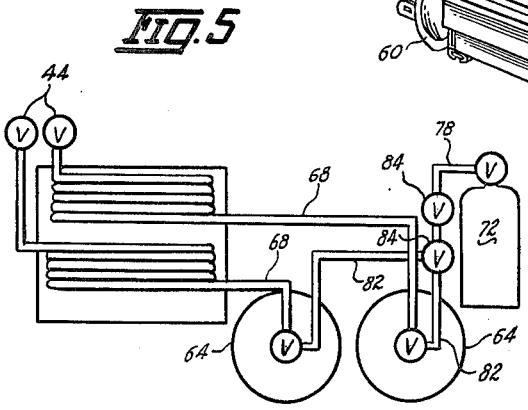
FIG. 5 is a schematic view of the cooling, charging and dispensing system used with this invention.

Referring to the drawings, the container portion of this invention is designated generally by the numeral 10, is preferably box-like in appearance as shown and of any desired size. The sidewalls 12, 14, front wall 16 and bottom or floor 18 are of insulated construction similar to refrigerator type boxes and the like in a well known manner. An insulated ice tray or chamber 20 is provided in the top interior of container 10 and communicates with the lower main compartment 22. Access to chamber 20 is provided by opening 24 in top 26 and a refrigerator type door 28 with appropriate hinges 30 and latch 32 serves as a closure for opening 24. The rear side 34 has the opening 36 to compartment 22 and is provided with the refigerator type door 38 having appropriate hinges 40 and latch 42.

Figure 3:
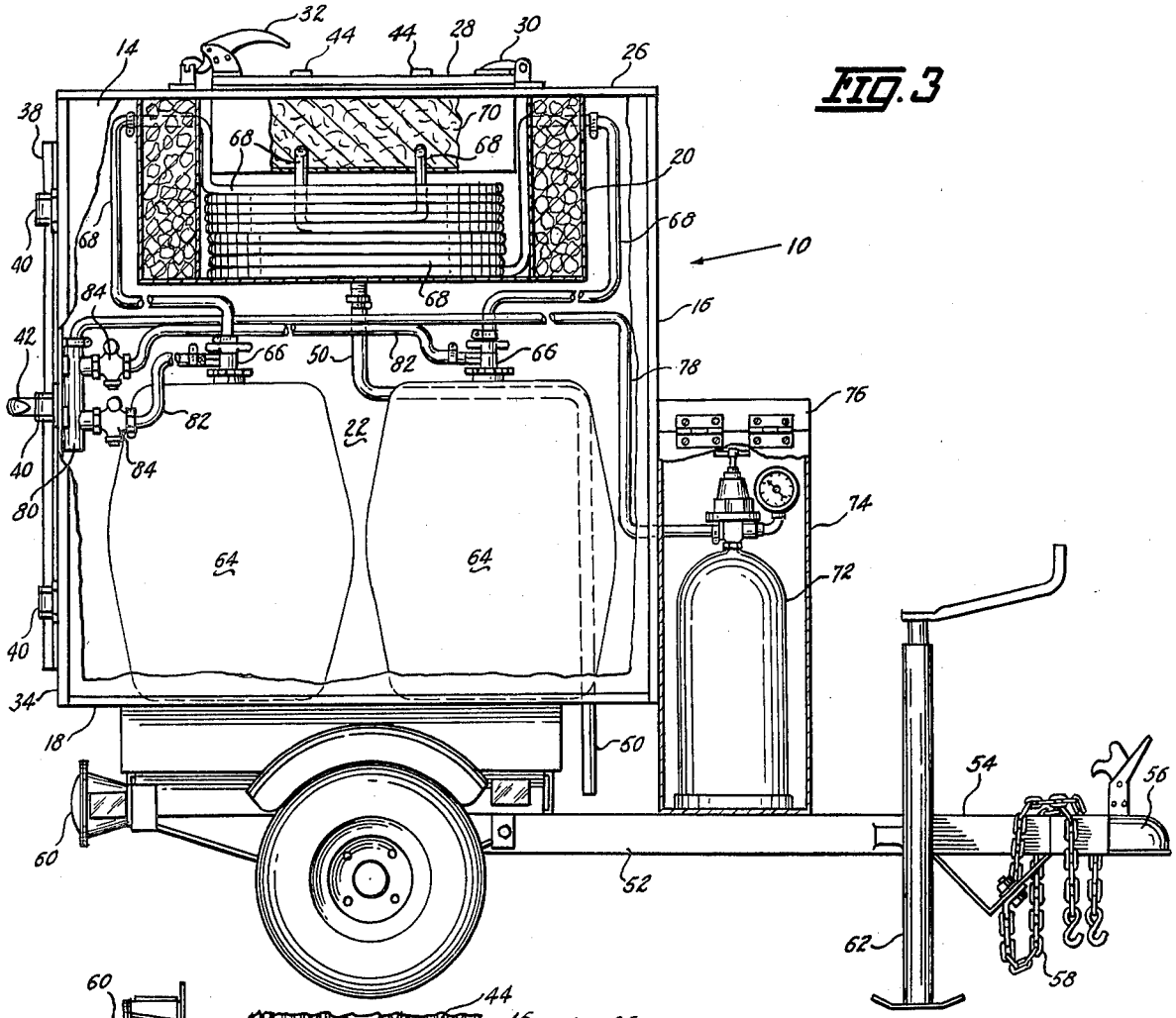
FIG. 3 is a side elevational view thereof partially broken away to show the placement of beverage receptacles, the refrigerating and dispensing means and the means for pressurizing the receptacles.
Figure 4:
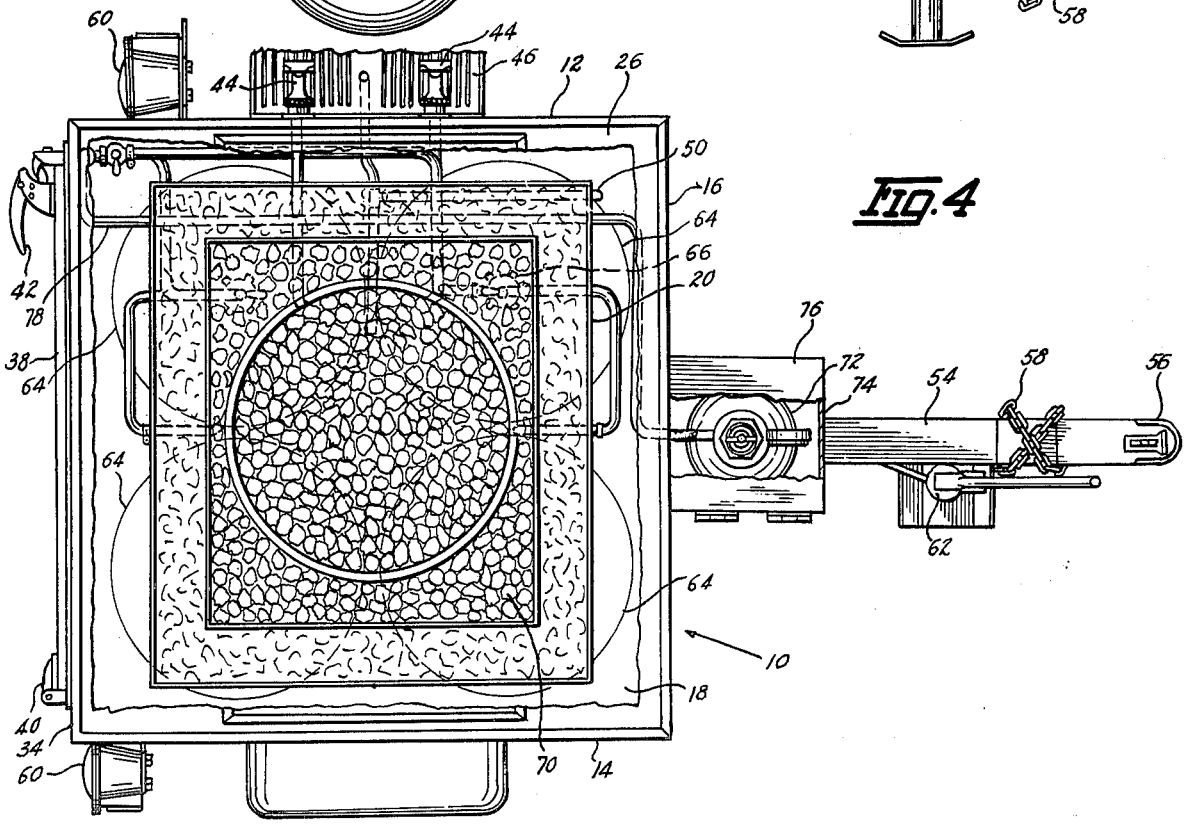
FIG. 4 is a top plan view thereof partially broken away to show the interior thereof seen in FIG. 3.

A pair of valved liquid dispensing spigots 44 are mounted near the top of side 12 and are disposed over a drip tray 46 having the drain pipe 48 operably connected to the interior drain pipe 50 that connects at one end to the ice chamber 20 and extends at its other end through the floor 18 as best seen in FIG. 3. Container 10 is suitably mounted on a sturdy compact road travelling trailer frame 52 that includes a tongue 54 provided with a hitch 56 and safety chain 58 adapted for attachment to a towing motor vehicle (not shown) in a well known manner. Trailer 52 also includes a rear lighting system 60 for operable connection to a towing vehicle which includes tail lights, brake lights, turn signals and license plate holder in a conventional manner for trailers of this type. A jack leg 62 is provided on tongue 54 for obvious purposes. Such trailer 52 makes possible the transporting of liquid refreshments at highway speeds to any desired site reachable by the towing vehicle.

Container 10 is designed to carry one or more liquid refreshment receptacles in compartment 22 here shown in the form of beer kegs 64, it being understood that such receptacles are equipped with fittings 66 for connection to dispensing apparatus. Accordingly, container 10 is equipped with one or more flexible dispensing hoses 68 operably connected at one end respectively to a spigot 44. A substantial length of hose 68 is coiled within chamber 20 to be surrounded by ice 70 for cooling and the other end of such hose extends through the wall of chamber 20 where it is available for quick coupling to fitting 66. Means for charging the contents of receptacles 64 are provided by the air cylinder 72 placed in housing 74 and mounted on trailer tongue 54 adjacent the front wall 16. A door 76 is provided for housing 74.

A pressure hose 78 from cylinder 72 extends through wall 16 to a manifold 80 on wall 34 and one or more hoses 82 attached to respective valves 84 connected to manifold 80 are available for attachment to respective fittings 66 on receptacles 64 as best seen in FIG. 3. By the above arrangements, there is thus provided a new and improved device to expedite and facilitate the delivery and dispensing of liquid refreshments particularly to remote locations such as picnic areas and the like. Accordingly, in view of the foregoing, it is thought a full understanding of the construcion and operation of this invention will be had and the advantages of the same will be appreciated.

I claim:

1. As a new article of manufacture, a portable beverage cooler and dispenser comprising in combination:

a wheeled trailer frame including a tongue and hitch for attachment to a motor vehicle and constructed with a capability for highway travel at highway speeds of such vehicle, an insulated closed container having a top, front, rear, bottom and opposed sides and suitably mounted on said trailer, an insulated ice chamber in the upper interior portion of said container defining a compartment in the lower portion thereof, said top provided with an opening communicating with said ice chamber, a latchable door on said container for said opening, said rear provided with an opening to said compartment a latchable door for the opening to said compartment, a valved spigot mounted to the exterior of one side of said container, a flexible dispensing hose connected at one end to said spitot and having its major length disposed in said ice chamber, the other end of said flexible hose being extended through said ice chamber into said compartment for operable connection to any liquid beverage receptable placed therein, a valved liquid charging means mounted on said tongue adjacent the front of said container, and a pressure hose within said compartment having one end adapted for attachment to any liquid beverage receptacle placed therein and the other end extended through the fron of said container for operable attachment to said liquid charging means.

2. An article as defined in claim 1 including:

a light system on said frame for use in road travel and adapted for operable connection to a source of power on a towing vehicle, and a jack leg on said tongue to maintain said container on a level plane when detached from a towing vehicle.

3. An article as defined in claim 1 including:

a drain pipe in said compartment connected at one end to said ice chamber and extending at its other end through the bottom of said compartment, a drip tray on said container below said spigot, and a second drain pipe connecting said drip tray to said first mentioned drain pipe.

* * * * *